United States Patent [19]

Anderson

[11] 4,261,375

[45] Apr. 14, 1981

[54] HAIR CURLER AND CRIMPER

[76] Inventor: Douglas Anderson, 850 Rosedale Ave., Apt. 20, Capitola, Calif. 95010

[21] Appl. No.: 50,982

[22] Filed: Jun. 22, 1979

[51] Int. Cl.[3] ..... A45D 8/26

[52] U.S. Cl. ..... 132/32 R; 132/31 R

[58] Field of Search ..... 132/31 R, 40, 32 R, 132/32 A, 32 B

[56] References Cited

U.S. PATENT DOCUMENTS

| | | | |
|---|---|---|---|
| 520,859 | 6/1894 | Nicol, Jr. | 132/32 B |
| 979,058 | 12/1910 | Bove | 132/32 R |
| 1,471,881 | 10/1923 | Bove | 132/32 R |
| 1,850,789 | 3/1932 | Cefalv et al. | 132/31 R |
| 2,818,869 | 1/1958 | Rose | 132/32 R |
| 3,547,135 | 12/1970 | Roos | 132/32 R |

FOREIGN PATENT DOCUMENTS

| | | | |
|---|---|---|---|
| 129129 | 12/1928 | Switzerland | 132/31R |

*Primary Examiner*—Paul J. Hirsch

*Attorney, Agent, or Firm*—Robert G. Slick

[57] ABSTRACT

A hair curler or crimper is provided which is particularly adapted for use with permanent waving solutions. The crimper is preferably made of one piece of a soft plastic which can be easily molded and which provides a lightweight, inexpensive crimping device.

1 Claim, 5 Drawing Figures

HAIR CURLER AND CRIMPER

SUMMARY OF THE INVENTION

The present invention relates to a hair-crimping device and one which is particularly adapted for use with permanent waving solutions.

In the past, crimping devices have been made which crimp the hair but which do not fully expose the hair to a waving or washing solution. Such devices are highly ineffective for hair permanent waves.

Other devices which have been suggested are made of metal or other materials which are subject to corrosion and are relatively heavy and expensive.

The device of the present invention is preferably cast from a single piece of a soft, yieldable plastic to provide a curler which is inert to chemical solutions, which is light in weight and inexpensive. Preferably the crimper has built-in clamps so that it can be merely snapped in place on the hair.

In accordance with one embodiment of the invention, the end sections are formed in such a way that a plurality of the crimping devices can be used, one after the other, on long strands of hair.

In accordance with the present invention, the device can be modified in various manners to provide a kinky effect, soft waves or the like.

Various additional features and objects of the invention will be brought out in the balance of the specification.

DESCRIPTION OF THE PREFERRED EMBODIMENTS

Figure 1:
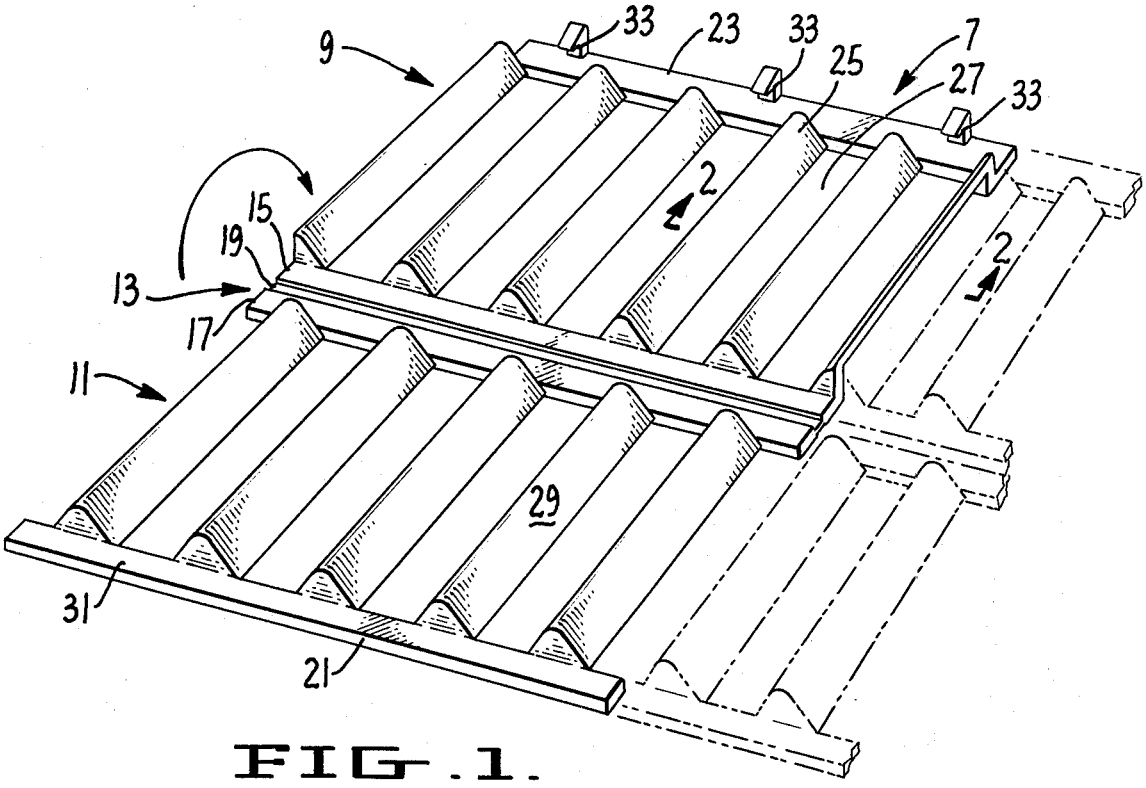
FIG. 1 is a perspective view of a crimping device embodying the present invention.

Referring now to the drawings by reference characters, the crimping device is generally designated 7. Broadly speaking, it is a somewhat flat rectangular structure having two halves 9 and 11 joined by a center section 13. The center section 13 has two flat side members 15 and 17 joined by a portion of reduced thickness 19. The two halves are substantially mirror images and only one is therefore described in detail. The halves are defined by the center section, previously mentioned, and the outer members 21 and 23. Between the members 15 and 23 are a plurality of upstanding ridges 25 and alternating with the ridges 25 are slots 27. As can be seen from the drawing, the slots and ridges alternate on each half of the device and the slots on one half are opposite the ridges on the other and vice versa. Thus, for instance, the slot 27 is opposite a ridge 29 on the opposite half. Preferably the inner sides of the ridges are hollow as at 28 since this maintains a uniform wall thickness making the device easier to mold. Also, the hollow structure conserves material and makes the device lighter in weight.

Figure 5:
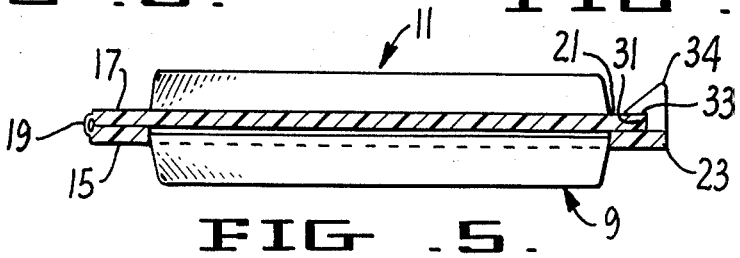
FIG. 5 is a section through the closed device.

Some means must be provided for holding the crimper in a folded-over relationship and this can be in the form of an external clip, not shown, or clip means can be formed as part of the structure. In the embodiment shown in FIGS. 1 and 5, the side member 21 has a ridge 31 therein, while on the opposite side member 23, there is formed snap 33. The snap can be pressed over the ridge, as is shown in FIG. 5, holding the device securely together. Arm 34 formed on snap 33 makes it easy to release the crimper. Obviously, other forms of clamp means can be used.

In use, strands of hair are placed over one of the halves and the other half is folded over it so that the two halves lie in side-by-side relationship with the hair extending over the ridges. This produces the effect shown in section in FIG. 2. Here the ridge 29 is shown folded into the opening 27 while the ridge 25 is shown folded into a corresponding slot on the opposite half and so on. Thus, it will be seen that the hair 35 extends over the ridge 25, passes through the center of the device where it is exposed on the ridge 29 and so on. Thus, the hair is held in a crimped position, yet is almost fully exposed to waving, washing, conditioning solutions or the like.

Figure 2:
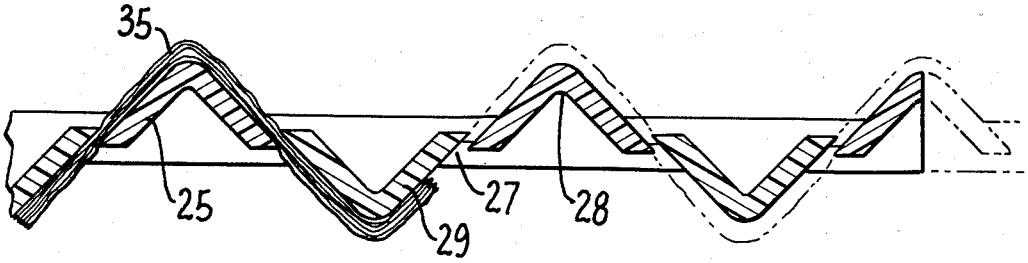
FIG. 2 is an enlarged section on the line 2—2 of FIG. 1.
Figure 3:
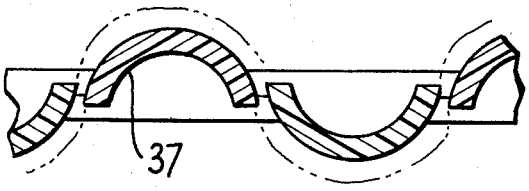
FIG. 3 is a section, similar to FIG. 2, showing an alternate form of the ridges.
Figure 4:
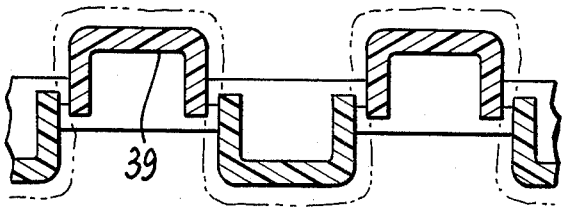
FIG. 4 is a view, similar to FIG. 3, showing another alternate form of the ridges.

In FIGS. 1 and 2, the ridges have been shown as being angular which results in a rather kinky look. The ridges can be formed in other shapes as is shown in FIGS. 3 and 4. In FIG. 3 the ridges 37 are in the form of half cylinders, while in FIG. 4 the ridges 39 are in the form of squares having rounded edges.

Preferably the entire device is molded of a relatively soft plastic to provide a one-piece device. However, the device can be fabricated by combining various parts in known matter. Thus, the center section might be made of a relatively soft plastic, while the frame members supporting the ridges might be made of a relatively hard plastic.

A simplified form of clamping means has been shown for clamping the two halves together. However, other clamping means can be substituted.

Various other embodiments and modifications can be made without departing from the spirit of this invention.

I claim:

1. A hair crimper comprising in combination:

a. a generally flat rectangular structure having first and second halves joined by a center section molded from a single piece of a relatively soft, yieldable plastic whereby the center section forms a living hinge integral with the two halves;

b. a series of alternating upstanding triangular ridges and slots formed in each of said halves running at a right angle to said center section, c. said ridges and slots being complementary to each other whereby a ridge can fit into a mating slot, d. the slots on one half corresponding in position to the ridges on the opposite half and vice versa, whereby e. hair can be placed between the halves, the halves bent toward each other so that the hair is pressed through the slots by said ridges, exposing the hair on both sides of the folded-over crimper and f. clamping means whereby the two halves can be clamped in face-to-face relationship said clamping means comprising a ridge on the outer edge of one half and a snap on the outer edge of the opposite half.

* * * * *